US007989020B2

(12) United States Patent
Strangman et al.

(10) Patent No.: US 7,989,020 B2
(45) Date of Patent: Aug. 2, 2011

(54) METHOD OF FORMING BOND COATING FOR A THERMAL BARRIER COATING

(75) Inventors: Thomas E. Strangman, Prescott, AZ (US); Derek Raybould, Denville, NJ (US); Devlin M. Gualtieri, Ledgewood, NJ (US)

(73) Assignee: Honeywell International Inc., Morristown, NJ (US)

( * ) Notice: Subject to any disclaimer, the term of this patent is extended or adjusted under 35 U.S.C. 154(b) by 1211 days.

(21) Appl. No.: 11/703,964

(22) Filed: Feb. 8, 2007

(65) Prior Publication Data

US 2008/0193663 A1 Aug. 14, 2008

(51) Int. Cl.
*B05D 3/02* (2006.01)

(52) U.S. Cl. ..... 427/226; 427/229

(58) Field of Classification Search ..... 427/229, 427/252

See application file for complete search history.

(56) References Cited

U.S. PATENT DOCUMENTS 3,779,719 A * 12/1973 Clark et al. ..... 428/652
4,801,513 A 1/1989 Duhl et al.
5,057,196 A 10/1991 Creech et al.
5,492,726 A 2/1996 Rose et al.
5,650,235 A * 7/1997 McMordie et al. ..... 428/610
5,688,607 A 11/1997 Rose et al.
5,740,515 A 4/1998 Beele
5,780,110 A 7/1998 Schaeffer et al.
5,935,407 A 8/1999 Nenov et al.
6,080,246 A 6/2000 Wing
6,291,014 B1 9/2001 Warnes et al.
6,299,986 B1 10/2001 Meelu
6,403,165 B1 * 6/2002 Grylls et al. ..... 427/456
6,620,518 B2 9/2003 Lavery et al.
2002/0132132 A1 9/2002 Bose et al.
2003/0044536 A1 3/2003 Rigney et al.
2005/0112381 A1 5/2005 Raybould et al.
2005/0145503 A1 7/2005 Kozlov et al.
2006/0057418 A1 3/2006 Fairbourn
2006/0115660 A1 * 6/2006 Strangman et al. ..... 428/469

FOREIGN PATENT DOCUMENTS

JP 63-063583 * 3/1988

* cited by examiner

*Primary Examiner* — Michael Cleveland
*Assistant Examiner* — Robert Vetere
(74) *Attorney, Agent, or Firm* — Ingrassia Fisher & Lorenz

(57) ABSTRACT

According to a method for forming a coating system on a turbine engine component substrate that comprises a nickel-based superalloy substrate having at least one refractory metal included therein, a nickel-based layer is formed on the substrate, the nickel-based layer comprising at least one active material selected from the group consisting of elemental silicon and a silicon compound. The at least one active material is then diffused into the substrate. An yttrium-modified platinum aluminide bond coating, or a MCrAlX bond coating, may be then formed over the active material-modified nickel-based layer.

11 Claims, 4 Drawing Sheets

METHOD OF FORMING BOND COATING FOR A THERMAL BARRIER COATING

TECHNICAL FIELD

The present invention relates to methods for thermal barrier coatings for superalloy substrates, including high pressure turbine engine components. More particularly, the present invention relates to bond coatings for thermal barrier coatings and methods of forming such bond coatings.

BACKGROUND

Turbine engines are used as the primary power source for various aircraft applications. Most turbine engines generally follow the same basic power generation process. Compressed air is mixed with fuel and burned, and the expanding hot combustion gases are directed against stationary turbine vanes in the engine. The vanes turn the high velocity gas flow partially sideways to impinge on the turbine blades mounted on a rotatable turbine disk. The force of the impinging gas causes the turbine disk to spin at high speed. Jet propulsion engines use the power created by the rotating turbine disk to draw more ambient air into the engine and the high velocity combustion gas is passed out of the gas turbine aft end to create forward thrust. Other engines use this power to turn one or more propellers, electrical generators, or other devices.

Since turbine engines provide power for many primary and secondary functions, it is important to optimize both the engine service life and the operating efficiency. Although hotter combustion gases typically produce more efficient engine operation, the high temperatures create an environment that promotes oxidation and corrosion. For this reason, diverse coatings and coating methods have been developed to increase the operating temperature limits and service lives of the high pressure turbine components, including the turbine blade and vane airfoils.

One category of conventional coatings includes ceramic materials as thermal barrier coatings, which are applied onto surfaces of turbine blades, vanes, and other components. The coated components frequently employ a metallic bond coating to improve component bonding to the ceramic thermal barrier coating. One example of a metallic bond coating is platinum aluminide. Another example of a metallic bond coating is a MCrAlY alloy wherein M is usually a metal such as Ni, Co, or Fe, such as NiCoCrAlY. Such coatings provide a bonding surface for the ceramic thermal barrier coating as a result of selective oxidation of aluminum to form an alumina ($Al_2O_3$) scale that grows very slowly at high temperatures by a diffusion process.

Current platinum aluminide and MCrAlY coatings tend to have unacceptable stability when formed on advanced third and fourth generation single crystal superalloys such as CMSX10O, EPM102, and TMS162. It is a challenge to craft bond coatings that have suitable compatibility with the superalloy substrate on which they are formed. Furthermore, interdiffusion between the bond coating and the underlying substrate material initiates the growth of a low-strength secondary reaction zone (SRZ), which penetrates the substrate and may be several times thicker than the bond coating. Also, loss of adhesion of the aluminum oxide or other oxide scale to the bond coating or to the overlying stabilized zirconia or other ceramic material may eventually limit the thermal barrier coating spalling life.

In view of the challenges associated with providing durable and effective thermal barrier coatings, there is a need for bond coatings that have improved stability on single crystal alloy substrates. There is also a need for methods of forming such coatings in a manner that prolongs adhesion of thermal growth oxide scales to both the underlying bond coating material and the overlying thermal barrier coating material.

BRIEF SUMMARY

One embodiment of the present invention provides a method for forming a coating system on a turbine engine component substrate that comprises a nickel-based superalloy substrate having at least one refractory metal included therein. A nickel-based layer is formed on the substrate, the nickel-based layer comprising at least one active material selected from the group consisting of elemental silicon and a silicon compound. The at least one active material is then diffused into the substrate.

Another embodiment of the present invention provides a method for forming a bond coating system on a turbine engine component substrate. As in the first embodiment, the substrate comprises a nickel-based superalloy substrate having at least one refractory metal included therein. A platinum layer is formed on the turbine engine component substrate. From a bath that includes a primary alcohol and a tertiary alcohol, and an electrolyte comprising an yttrium salt, an electrodepositing step is performed during which yttrium from the yttrium salt is deposited onto the platinum layer. The turbine engine component is then heated to diffuse the yttrium into the platinum layer to form a modified platinum region. Then, the aluminum is diffused into the modified platinum layer to thereby form a modified platinum aluminide region.

Other independent features and advantages of the preferred methods will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

The present invention includes methods for producing a thermal barrier coating to protect a substrate, and for forming a bond coating between the substrate and the thermal barrier coating. The bond coating includes an active element such as yttrium in its elemental form in order to improve the bond coating stability, particularly on single crystal alloy substrates, and to prolong adhesion of a thermally-grown oxide interlayer to the bond coating and to the thermal barrier coating. Furthermore, the present invention includes methods for inhibiting formation of a secondary reaction zone in the substrate during formation of the bond coating and the thermal barrier coating.

Figure 1:
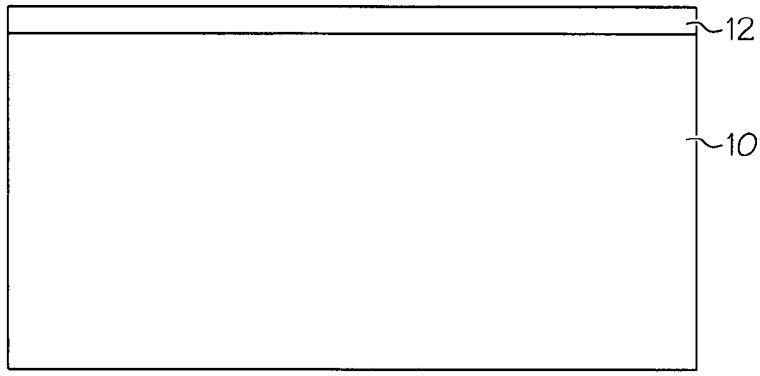
FIGS. 1 to 2 are cross-sectional views depicting a substrate having a secondary reaction zone nucleation inhibitor formed therein.
Figure 2:
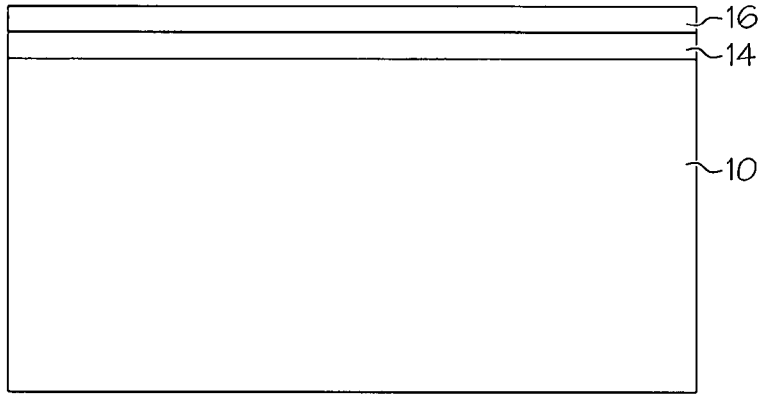

Turning now to FIGS. 1 and 2, method steps for inhibiting formation of a secondary reaction zone in a substrate 10 are depicted. Exemplary substrate materials are commonly referred to as third and fourth generation nickel-based single crystal superalloys, which have relatively high refractory element concentrations. Some exemplary refractory elements that may be included in the nickel-based superalloy include tungsten, tantalum, molybdenum, niobium, rhenium, and ruthenium. For example, CMSX10, EPM102 & TMS162 are nickel-based single crystal superalloys having a relatively high refractory element content, and are used as substrate material for components that are used in demanding applications such as turbine engine blades and stators. As an example, CMSX10 has a nominal composition of 1.5-9.0 wt % Co, 1.8-4.0 wt % Cr, 0.25-2.0 wt % Mo, 3.5-7.5 wt % W, 7.0-10.0 wt % Ta, 5.0-7.0 wt % Al, 0.1-1.2 wt % Ti, 0-0.15 wt % Hf, 5.0-7.0 wt % Re, 0-0.5 wt % Nb, 0-0.04 C and balance Ni.

Of particular concern for highly alloyed nickel-base single crystal superalloys, such as CMSX-10, is the formation of a highly problematic secondary reaction zone (SRZ) that can be initiated by interdiffusion of materials from an adjacent coating. The SRZ is brittle and may grow to several times the thickness of the coating. The SRZ involves a transformation of the high strength single crystal microstructure, a brickwork of fine cuboidal gamma prime particles within a gamma matrix, to a lower strength microstructure comprised of topological-closed-packed and gamma phases within a gamma prime matrix. After initiation, the SRZ grows as a function of time and temperature. The SRZ reduces the effective load-bearing wall thickness during the service life of a component such as a turbine blade.

To prevent formation of a secondary reaction zone and thereby maintain the discontinuous gamma prime phase organization, the activity of the refractory elements within the gamma and gamma prime phases should be reduced in the substrate region that is immediately adjacent to the coating. This may be achieved by partial de-alloying of the gamma and gamma prime phases in that region by forming refractory silicides in the substrate prior to the formation of a diffusion aluminide or a NiCoCrAlX overlay coating. For example, a metal layer 12 that includes a low percentage of silicon is deposited over the substrate 10 and then the silicon in the metal layer 12 is thermally diffused into the substrate. The metal layer 12 may also include a low percentage of carbon. An exemplary metal layer 12 includes about 3 wt. % silicon, with the balance being nickel. Another exemplary metal layer 12 includes nickel, along with about 3 wt. % silicon carbide. The metal layer 12 may be formed by sputtering nickel+silicon, or nickel+silicon carbide material onto the substrate 10. Other suitable methods include electron beam physical vapor deposition and electroplating. Sufficient diffusion stability is provided by forming the metal layer 12 at a thickness ranging between about 10 and about 50 microns. If silicon carbide is to be used, an alternate method includes entrapping fine silicon carbide particles in the surface of the substrate 10. This may be performed by briefly blasting the substrate surface with silicon carbide grit. According to this alternate method, the metal layer 12 will include the original substrate material with the entrapped silicon carbide.

After forming the metal layer 12, the substrate 10 is heated to a temperature ranging between about 900 and about 1050° C. During the heating step, the silicon rapidly diffuses into the substrate to a depth of about 15 to 25 microns to leave behind a nickel layer 16 that is substantially gamma phase nickel. The silicon that diffuses into the substrate 10 reacts with refractory elements in the substrate 10 to form a layer 14 that maintains the discontinuous gamma prime phase organization and further includes refractory suicides. If silicon carbide is included in the metal layer 12, the silicon carbide decomposes during the heating step, and the silicon and carbon atoms diffuse into the substrate 10 and react with refractory elements to form refractory carbides and silicides in the layer 14. Reducing the concentration of the refractory elements within the gamma and gamma prime phases by forming refractory silicides and/or carbides improves the stability of the gamma/gamma prime matrix, and thereby inhibits nucleation of a secondary reaction zone in the adjacent unaltered substrate 10.

Figure 3:
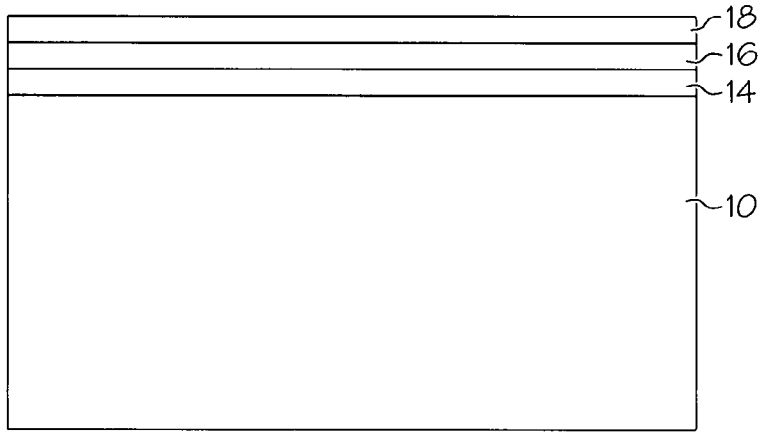
FIGS. 3 to 5 are cross-sectional views depicting a substrate having a modified platinum layer formed thereon, the modified platinum layer being shown over the secondary reaction zone nucleation inhibitor formed according to the steps depicted in FIGS. 1 and 2.
Figure 4:
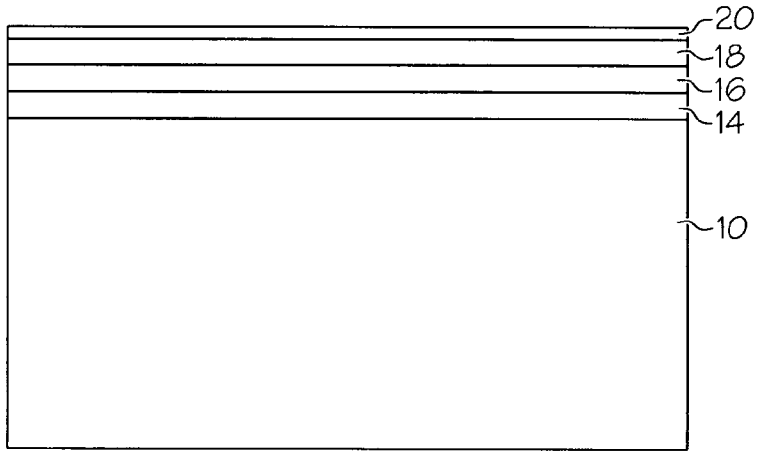
Figure 5:
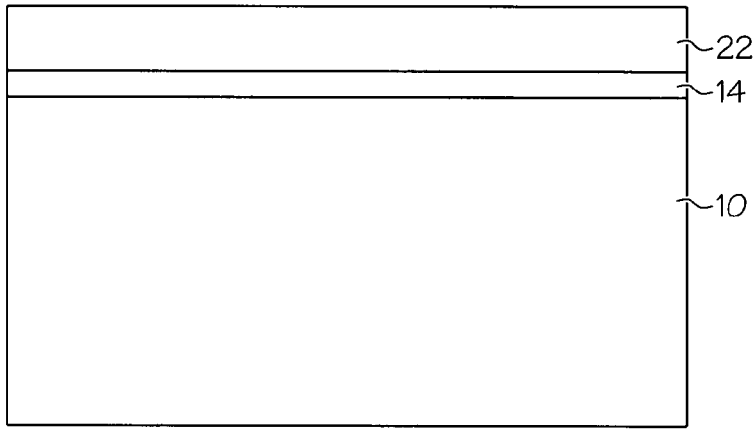

Turning now to FIGS. 3 to 5, a modified platinum layer is formed on the substrate 10 that includes the layer 14 having the refractory silicides and/or carbides formed therein, the layer 14 functioning as a secondary reaction zone nucleation inhibitor. A layer of platinum 18 is formed using a suitable method, which may include an electrodeposition process such as electroplating. Other suitable processes for forming the platinum layer 28 include cold spraying, chemical and/or vapor deposition, and plasma spraying. After deposition the platinum layer, a heat treatment may be performed to alloy or interdiffuse the platinum with the adjacent nickel-based layer. Next, a layer of yttrium 20 is formed over the platinum layer 18. The yttrium is subsequently diffused with the platinum and nickel layers to form a modified platinum layer 22. As will be explained in detail, the yttrium modification of the platinum will subsequently result in an yttrium-modified platinum aluminide bond coating following an aluminization process. Adhesion of a subsequently formed thermally grown oxide to the platinum aluminide bond coating is enhanced by the presence of yttrium.

As a preliminary note, it is recognized that the benefits of adding yttrium to the platinum-aluminide bond coating is not limited to the previously-discussed third or fourth generation superalloys. The same advantages may be achieved by forming an yttrium-modified platinum aluminide bond coating for all nickel based superalloys.

The layer of yttrium 20 may be formed by electroplating yttrium to a suitable thickness. In an exemplary embodiment, the yttrium is formed to a submicron thickness, although in some embodiments the yttrium layer 20 is thicker than one micron. The yttrium layer thickness is preferably determined with an aim toward obtaining an yttrium concentration ranging between about 0.05 and 0.5 wt. % in the subsequently-formed platinum aluminide layer. Although the electroplating parameters may vary as necessary, including parameters regarding the electrolytic bath, the electroplating environment, and electrical parameters, an exemplary method involves the use of an electrolyte solvent that includes a mixture of a primary and a tertiary alcohol, and further includes an yttrium salt as an electrolyte. Alcohols are used as a solvent instead of an aqueous solution for electrodeposition of the yttrium layer 20. In an exemplary electrodeposition method, the electrolyte bath is substantially or entirely nonaqueous. Furthermore, excellent active element layers are formed when the entire solvent composition in the electrolyte bath consists essentially of a mixture of a primary and a tertiary alcohol. Exemplary primary alcohols in the electrolyte bath include methanol and ethanol, and an exemplary tertiary alcohol is alpha terpineol. Effective electrodeposition of yttrium is obtained using pure ethanol as a primary alcohol, although denatured ethanol that includes some methanol (i.e. 5% methanol) is also suitable.

The electrolyte bath for the electrodeposition process has a substantial tertiary alcohol component. For example, the tertiary alcohol may be included at a concentration ranging between 20 and 80 percent of the total solvent volume, with the substantial remainder of the total solvent weight being a primary alcohol. Exemplary primary alcohols in the electrolyte bath include methanol and ethanol, and an exemplary tertiary alcohol is alpha terpineol. Effective electrodeposition of yttrium is obtained using pure ethanol as a primary alcohol, although denatured ethanol that includes some methanol (i.e. 5% methanol) is also suitable. An exemplary electrolyte solvent is a tertiary alcohol and a primary alcohol at about a 1:1 volume ratio.

The electrolyte in the bath includes an yttrium salt. An exemplary electrolyte solute includes $Y(NO_3).3H_2O$, which is a dehydration product obtainable by roasting $Y(NO_3).6H_2O$ at a suitable temperature (i.e. 100° C.) to remove three waters of hydration. The electrolyte is included in the bath solution at least at a 10 mM concentration, and preferably at least at a 100 mM concentration, and more preferably at least at a 200 mM concentration.

A buffer may also be included in the electrolyte bath as necessary. An exemplary buffer is sodium acetate. However, sodium acetate is commonly obtained in a hydrated form, typically with three waters of hydration per molecule of sodium acetate. According to an exemplary method, sodium acetate is dehydrated by heating above 123 ° C. to form anhydrous sodium acetate before adding the buffer to the electrolyte bath. Sodium acetate may be included in the bath at a 5 to 20 mM concentration, and is preferably included at about a 10 mM concentration.

After preparing the electrodeposition bath, yttrium is electrodeposited onto the component substrate 10 including the diffusion layer 14 having the refractory suicides, and preferably further including the nickel layer 16. Prior to deposition, the component surface may be prepared by masking areas on which a coating is undesirable. The masking material may be any conventional masking substance that is compatible with the alcohol bath. The component may also undergo sufficient cleaning using a suitable solvent such as methanol. During electrodeposition, the component being coated with the active metal functions as an electrode in the bath, typically the cathode, by attaching electrical leads to a non-insulated portion of the component surface.

In order to prevent oxidation of the component surface, or oxidation of the active metal being electrodeposited onto the surface, the bath is placed in a controlled and substantially oxygen-free environment during the electrodeposition process. For example, an inert gas may be blown over the bath, or the bath may be placed into a chamber of the inert gas. Suitable inert gases include dry nitrogen and argon. An exemplary electrodeposition process is performed at an ambient temperature ranging between about 0 and about 50° C., with a narrower exemplary range being between about 20 and about 25° C.

Electrical parameters for electrodeposition of the yttrium onto the component substrate may be adjusted depending on factors such as the desired coating thickness and the substrate composition. According to an exemplary embodiment, a current of about 2 mA per square inch of component surface area to be coated is applied during electrodeposition, and is maintained for about an hour.

After electrodepositing the yttrium, the component is heat annealed to thermally diffuse the yttrium into the underlying component surface. Since yttrium readily oxidizes at room temperature, a brazing adhesive may be used as an oxidation protective coating over the active metal prior to heat annealing the component. If a brazing adhesive or other oxidation protection coating is used, the coating should be selected that will readily vaporize below the diffusion temperature so the coating material does not contaminate the diffusion coating. Furthermore, an exemplary thermal diffusion method is performed under vacuum pressure in order to remove oxygen from the annealing environment. According to an exemplary method, diffusion of yttrium into the adjacent Pt and Ni layers is performed at a temperature ranging between 1000 and 1150° C. in a vacuum or inert gas environment.

The yttrium may also be electroplated, using the same or a similar procedure and parameters, directly onto the nickel-based layer or superalloy, followed by electroplating platinum over the yttrium. The platinum and yttrium layers are then heat treated at a suitable temperature such as about 600° C. to cause sufficient bonding for the part to be handled prior to subsequent processing. Alternatively, the platinum and yttrium layers may be heat treated at a higher temperature, such as between 900 and 1150° C., to diffuse the platinum into the superalloy, and to further diffuse the yttrium into both the superalloy and the platinum.

Figure 6:
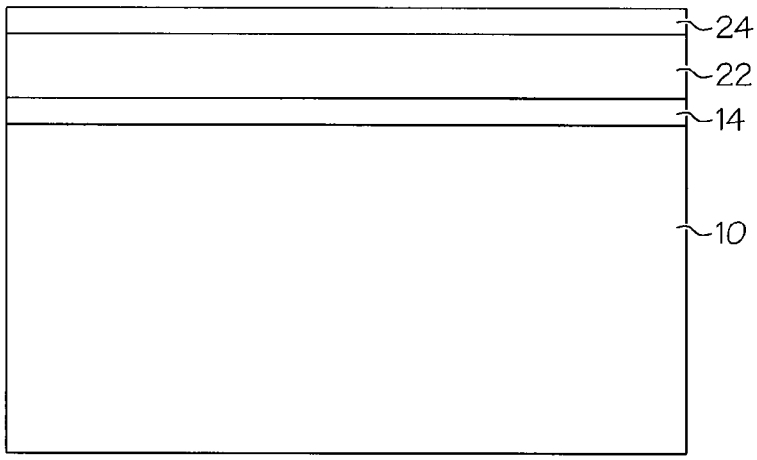
FIGS. 6 to 7 are cross-sectional views depicting a substrate having a modified platinum aluminide bond coating formed therein by aluminizing the modified platinum layer formed according to the method steps depicted in FIGS. 3 to 5.
Figure 7:
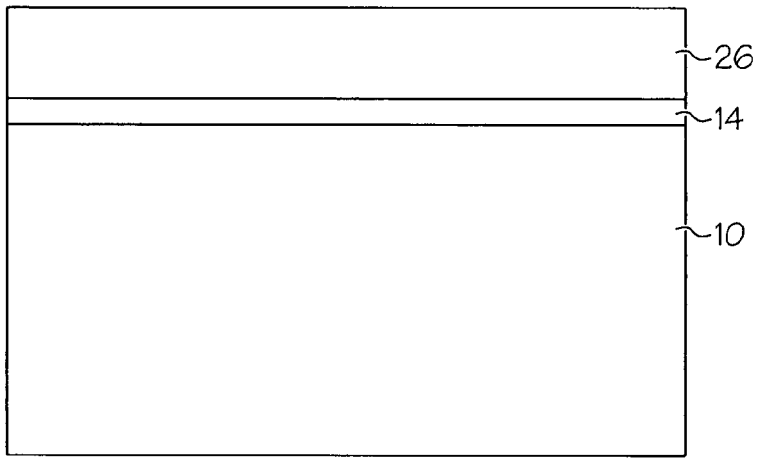

Turning now to FIGS. 6 and 7, after diffusing the yttrium into the platinum to form the modified platinum layer 22, an aluminizing step is performed to yield a bond coating layer 26 of yttrium-modified platinum aluminide having an yttrium concentration ranging between about 0.05 and about 0.5 wt. %. Exemplary methods for performing the aluminizing step include gas phase and chemical vapor deposition. Process heat that is provided during the chemical vapor deposition or a post-aluminizing heat treatment enables inward diffusion of aluminum and/or outward diffusion of nickel and platinum from the modified platinum layer 22 to form the modified platinum aluminide 26 in a single step.

Alternatively, a layer of aluminum 24 (as depicted in FIG. 6) may be formed on the modified platinum layer 22 using one of numerous methods, including cold spraying or various deposition methods including chemical vapor deposition and physical vapor deposition. Then, the aluminum is thermally diffused into the modified platinum layer to form the modified platinum aluminide bond coating layer 26. According to one exemplary method, thermal diffusion of aluminum into the modified platinum layer is performed in a vacuum by maintaining a temperature of about 1080° C. for about four hours.

As an alternative to the yttrium modified platinum aluminide, the bond coating layer 26 may be a MCrAlX alloy, wherein M is a metal such as nickel and/or cobalt, and X is one or more active elements such as yttrium, hafnium, and/or silicon. In an exemplary embodiment, the MCrAlX alloy includes both nickel and cobalt. Furthermore, in an exemplary embodiment the MCrAlX alloy includes yttrium as component X since adhesion of a subsequently formed thermally grown oxide to the bond coating is enhanced by the presence of yttrium. For any MCrAlX alloy, the steps depicted in FIGS. 3 to 6 are replaced with a step of forming the bond coating layer 26 as a MCrAlX alloy. One of numerous methods to apply the MCrAlX alloy may be selected, including physical vapor deposition, cold spraying, plasma spraying, and electrodeposition.

Figure 8:
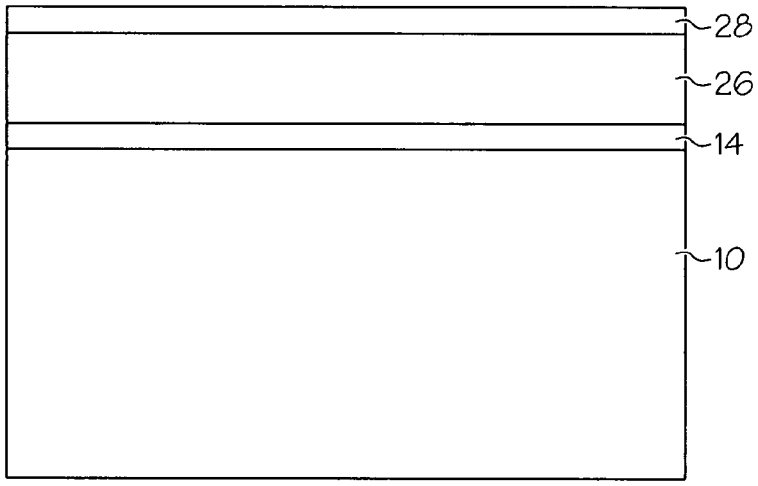
FIGS. 8 to 10 are cross-sectional views depicting a substrate having a thermal barrier coating formed thereon, the thermal barrier coating being shown over a bond coating such as a MCrAlX coating or the platinum aluminide bond coating formed according to the method steps depicted in FIGS. 6 to 7.
Figure 9:
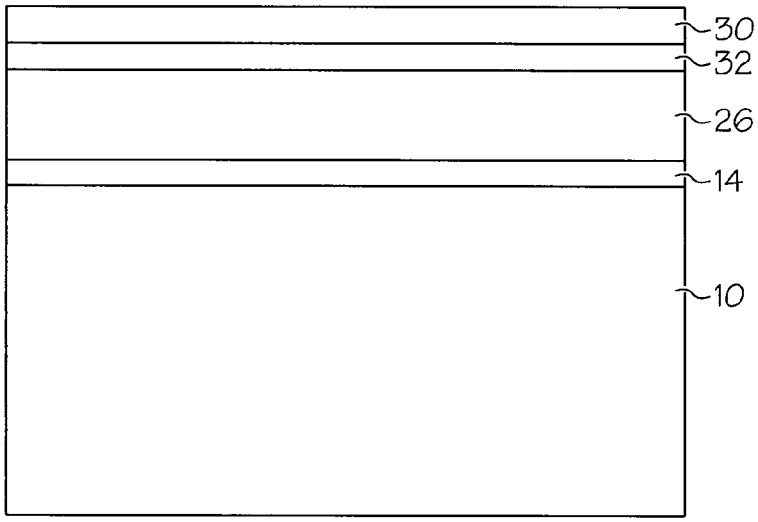
Figure 10:
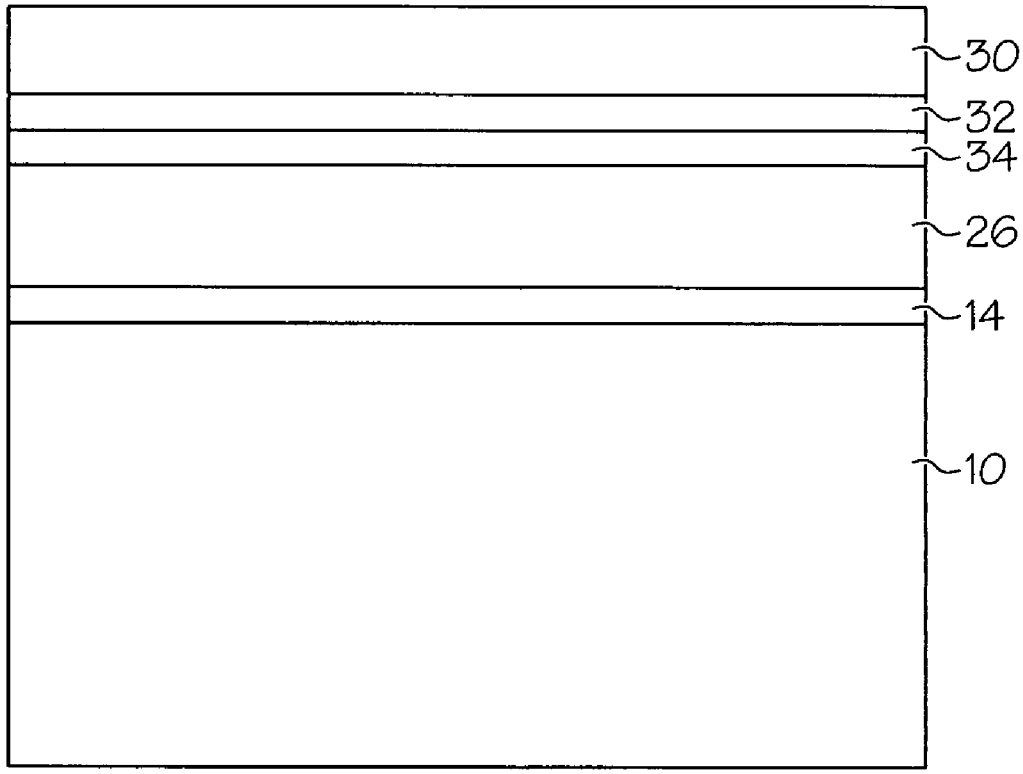

FIGS. 8 to 10 are cross-sectional views depicting step for forming a thermal barrier coating over the bond coating 26. First, an optional thin layer of crystallographically metastable alumina 28 is applied over the bond coating 26. The metastable alumina layer 28 may be applied to the bond coating surface at a thickness ranging between about 0.1 and about 5 microns, and preferably at a thickness of 0.5 to 2 microns. As non-limiting examples, the layer 28 may be formed by a sol gel process or a physical vapor deposition process such as electron beam physical vapor deposition, although the sol gel process is used in a preferred embodiment.

Following application of the metastable alumina layer 28, a thermal barrier coating 30 may be applied using a conventional technique such as electron beam physical vapor deposition. The thermal barrier coating is a ceramic material such as zirconia or hafnia, and is stabilized with an oxide such as yttria. The thermal barrier coating thickness may vary according to design parameters, and an exemplary coating ranges in thickness between about 50 and about 1000 microns. Following deposition of the thermal barrier coating 30, a heat treatment may be performed. For example, if the thermal barrier coating 30 is yttria stabilized zirconia or yttria stabilized hafnia, the heat treatment may performed at a temperature ranging between about 1000 and 1150° C. The heat treatment is preferably performed in an inert environment such as an argon atmosphere, or under vacuum pressure.

During formation of the thermal barrier coating 30, the metastable alumina layer 28 has solubility for the thermal barrier coating constituents such as zirconia. Transformation of the metastable alumina to the stable alpha phase initiates during deposition and is completed during the post-coating heat treatment. Since alpha alumina has negligible solubility for zirconia and yttria, transformation of the metastable alumina to the alpha phase results in precipitation of a fine dispersion of zirconia and yttrium aluminum garnet phases within the transformed alumina layer. The thermal treatment thus facilitates development of a mixed zone interfacial layer 32 of a thermally grown oxide from the underlying bond coating 26, alpha alumina, and a fine dispersion of zirconia, hafnia, and/or other constituents from the thermal barrier coating 30. The presence of the mixed zone 32 may reduce any potential thermal expansion mismatch, and therefore improve cohesion, between the thermally grown oxide from the bond coating 26 and the thermal barrier coating 30.

Referring to FIG. 10, a thermally grown alpha alumina layer 34 may grow between the mixed zone interfacial layer 32 and the bond coating 26 after exposure to a high temperature oxidizing environment. The alpha alumina layer is a product of continued oxidation of the bond coating 26 during a post-coating thermal treatment or during operation of the component in a gas turbine or other extreme environment. The improved bonding of the thermal barrier coating 30 to the mixed zone interfacial layer 32, and in turn, to the bond coating 26, constrains subsequent growth of the alpha alumina layer 34. This constraint of alpha alumina growth may result in partial relaxation of in-plane growth stresses that occur within the thermally grown alpha alumina layer 34, and therefore may reduce the driving force for rumpling at the interface between the thermal barrier coating 30 and the bond coating 26.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method for forming a coating system on a turbine engine component substrate that comprises a nickel-based superalloy substrate having at least one refractory metal included therein, the method comprising the steps of:

forming a nickel-based layer on the nickel-based superalloy substrate, the nickel-based layer comprising at least one active material selected from the group consisting of elemental silicon and a silicon compound;

diffusing the at least one active material into the nickel-based superalloy substrate to react the active material with the at least one refractory metal in the nickel-based superalloy to produce a diffusion layer comprising refractory metal silicides directly on top of the nickel-based superalloy substrate; and forming a bond coating on the diffusion layer.

2. The method according to claim 1, wherein:

the step of diffusing the at least one active material comprises diffusing elemental silicon into the substrate, and reacting the elemental silicon with the at least one refractory metal to produce the refractory metal silicides.

3. The method according to claim 1, wherein the step of diffusing the at least one active material comprises diffusing silicon carbide into the substrate, the method further comprising the steps of:

reacting the silicon carbide with the at least one refractory metal to produce a refractory metal silicide and a refractory metal carbide.

4. The method according to claim 3, further wherein the step of forming the nickel-based layer comprises blasting the substrate with silicon carbide grit.

5. The method according to claim 1, wherein the step of forming the bond coating comprises forming an alloy on the substrate having the composition MCrA1X, wherein M is at least one metal selected from the group consisting of nickel and cobalt, and X is an active material selected from the group consisting of yttrium, hafnium, and silicon.

6. The method according to claim 1, wherein the step of forming the bond coating comprises forming platinum aluminide modified with yttrium on the substrate.

7. The method according to claim 1, further comprising the step of:

forming an alumina coating on the bond coating.

8. The method according to claim 7, wherein the step of forming the alumina coating is performed by a sol gel process.

9. The method according to claim 7, further comprising the step of:

forming a thermal barrier coating comprising a ceramic material on the alumina coating.

10. The method according to claim 1, further comprising the step of:

forming a thermal barrier coating comprising a ceramic material on the bond coating.

11. The method according to claim 1, wherein the nickel based layer is between 10 and 50 microns thick.

* * * * *